US010280040B2

(12) United States Patent
Steinhauer

(10) Patent No.: US 10,280,040 B2
(45) Date of Patent: May 7, 2019

(54) ELEVATOR SYSTEM

(71) Applicant: ThyssenKrupp Elevator AG, Essen (DE)

(72) Inventor: Eduard Steinhauer, Nürtingen (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 0 days.

(21) Appl. No.: 15/129,071

(22) PCT Filed: Mar. 25, 2015

(86) PCT No.: PCT/EP2015/056451
§ 371 (c)(1),
(2) Date: Sep. 26, 2016

(87) PCT Pub. No.: WO2015/144781
PCT Pub. Date: Oct. 1, 2015

(65) Prior Publication Data

US 2017/0107080 A1 Apr. 20, 2017

(30) Foreign Application Priority Data

Mar. 28, 2014 (DE) ..... 10 2014 104 458

(51) Int. Cl.
*B66B 9/00* (2006.01)
*B66B 1/36* (2006.01)
*B66B 11/04* (2006.01)

(52) U.S. Cl.
CPC ..... *B66B 9/003* (2013.01); *B66B 1/36* (2013.01); *B66B 11/0407* (2013.01)

(58) Field of Classification Search
CPC ..... B66B 9/003; B66B 1/36; B66B 11/0407
See application file for complete search history.

(56) References Cited

U.S. PATENT DOCUMENTS 3,658,155 A * 4/1972 Salter ..... B66B 39/00 187/270
3,896,736 A * 7/1975 Hamy ..... B66B 9/003 104/127

(Continued)

FOREIGN PATENT DOCUMENTS

CN 101172466 A 5/2008
EP 3 122 680 B1 8/2018

(Continued)

OTHER PUBLICATIONS

English abstract for JPH0648672.

(Continued)

*Primary Examiner* — Michael A Riegelman
(74) *Attorney, Agent, or Firm* — thyssenkrupp North America, Inc.

(57) ABSTRACT

An elevator system may include at least two elevator shafts and at least one elevator car. A vertically extending rail may be disposed in each elevator shaft, and the elevator car may travel along the vertically extending rail. Each rail may be formed with a rotatable segment such that the rotatable segments can be aligned relative to one another in a transfer plane. Thereafter, the elevator car may travel between the elevator shafts along the segments. In some cases, the vertically extending rail may form part of a linear drive that causes the elevator car to move without the use of cables.

13 Claims, 4 Drawing Sheets

(56) References Cited

U.S. PATENT DOCUMENTS

| | | | | |
|---|---|---|---|---|
| 4,004,654 | A * | 1/1977 | Hamy | B66B 9/003 104/127 |
| 5,235,144 | A * | 8/1993 | Matsui | B66B 9/003 187/250 |
| 5,547,059 | A * | 8/1996 | Watanabe | B66B 5/18 187/288 |
| 6,189,657 | B1 * | 2/2001 | Jessenberger | B66B 11/0407 187/289 |
| 9,248,994 | B2 * | 2/2016 | Grundmann | B66B 39/00 |
| 2006/0163008 | A1 | 7/2006 | Godwin | |
| 2007/0199770 | A1 * | 8/2007 | Kocher | B66B 11/0407 187/277 |
| 2011/0132693 | A1 * | 6/2011 | Altenburger | B66B 9/00 187/240 |
| 2017/0088396 | A1 * | 3/2017 | Fargo | B66B 1/32 |
| 2017/0225927 | A1 * | 8/2017 | Kirsch | B66B 11/0407 |
| 2018/0009636 | A1 * | 1/2018 | Jedryczka | B66B 9/003 |
| 2018/0257911 | A1 * | 9/2018 | Gainche | B66B 9/003 |

FOREIGN PATENT DOCUMENTS

| | | | |
|---|---|---|---|
| JP | H04148785 | A | 5/1992 |
| JP | H05186169 | A | 7/1993 |
| JP | H0648672 | A | 2/1994 |

OTHER PUBLICATIONS

International Search Report for International Patent Application No. PCT/EP2015/056451 dated Jul. 1, 2015 (dated Jul. 8, 2015).
Chinese Office Action issued in CN 201580017027.4, dated Jan. 2, 2018. [[No English translation available]].

* cited by examiner

ELEVATOR SYSTEM

CROSS REFERENCE TO RELATED APPLICATIONS

This application is a U.S. National Stage Entry of International Patent Application Serial Number PCT/EP2015/056451, filed Mar. 25, 2015, which claims priority to German Patent Application No. DE 10 2014 104 458.4 filed Mar. 28, 2014, the entire contents of both of which are incorporated herein by reference.

FIELD

The present disclosure relates to elevator systems and, more particularly, to elevator systems and methods for operating such elector systems wherein elevator cars can travel along vertically extending rails disposed in elevator shafts.

BACKGROUND

The present invention relates to an elevator system and to a method for operating an elevator system having at least two vertical elevator shafts and having at least one elevator car, wherein, in each elevator shaft, there is arranged at least one vertically extending rail along which the elevator car can be caused to travel.

PRIOR ART

In elevator systems, elevator cars are normally restricted to a particular elevator shaft, and can usually be caused to travel only within that elevator shaft. Elevator systems are duly known in which elevator cars can be transferred between different elevator shafts, but such a transfer normally involves considerable effort.

Normally, various elements for causing the elevator car to travel, such as drives, supporting cables or guide rails, are arranged in one elevator shaft. If it is sought to transfer an elevator car from a first elevator shaft into a second elevator shaft, the elevator car is firstly separated from all such elements in the first elevator shaft, is transported from the first elevator shaft into the second elevator shaft, and is connected to corresponding elements in the second elevator shaft. Transportation of the elevator car between elevator shafts is in this case normally possible only by way of complex mechanisms.

Such a transfer of elevator cars thus involves great effort and is time-consuming. It may be the case that the entire elevator system has to be put out of operation during the transfer process.

Therefore a need exists for flexible transfers, involving little effort, of elevator cars between elevator shafts.

DETAILED DESCRIPTION

Figure 1:
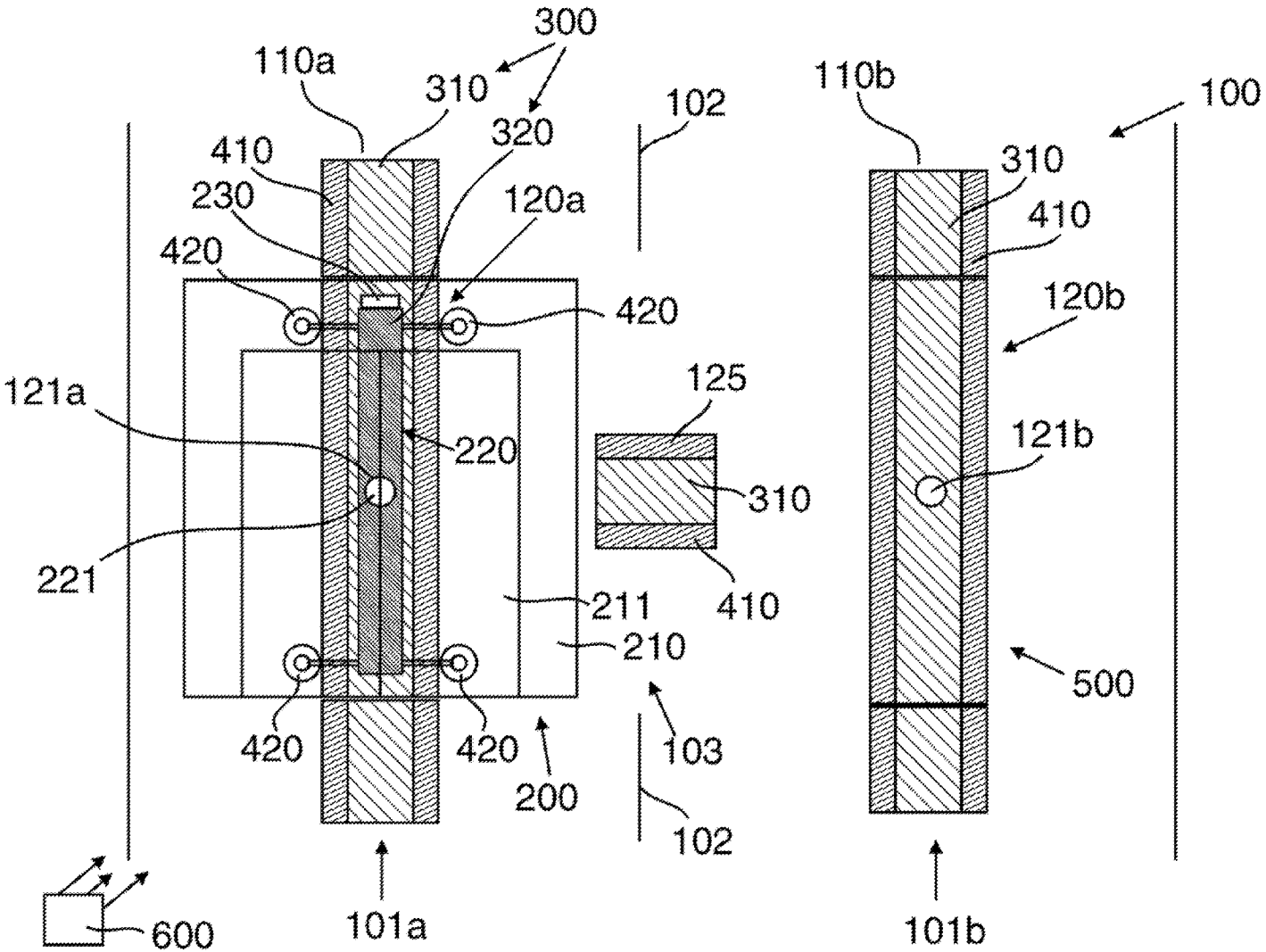
FIG. 1 is a schematic view of an example elevator system wherein an example elevator car is positioned in an example transfer plane in a first elevator shaft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element.

The present disclosure generally concerns elevator systems and methods for operating such elevator systems. One example elevator system may include at least two vertical elevator shafts and at least one elevator car. At least one vertically extending rail may be disposed in each elevator shaft along which an elevator car can travel.

An elevator system according to the invention comprises at least two vertical elevator shafts and at least one elevator car. In each elevator shaft there is respectively arranged at least one rail along which the elevator car can be caused to travel. Each of the rails has at least one segment designed to be rotatable. Said rotatable segments can be aligned relative to one another such that the elevator car can be caused to travel between the elevator shafts along the segments. The elevator car can thus be caused to travel between adjacent elevator shafts along rotated segments of two rails in the elevator shafts.

For this purpose, the segments are rotated about a horizontal axle such that they are aligned with one another and together form a horizontally running rail.

In particular, the elevator car is caused to travel between two adjacent elevator shafts. In particular, respective segments of the two rails in the two adjacent elevator shafts between which the elevator car is caused to travel are rotated. Said two rotated segments, in the rotated state, form a (substantially) closed rail (substantially) without gaps, along which the elevator car is caused to travel between said two elevator shafts.

In particular, the segments are rotated through 90°. By rotation of the segments, a horizontal rail is thus formed along which the elevator car is caused to travel horizontally. Furthermore, it is in particular also possible for the segments to be rotated through an expedient angle. Thus, an oblique rail is formed, that is to say a rail which is inclined relative to the elevator shaft by the expedient angle. The elevator car is caused to travel obliquely relative to the elevator shafts along said oblique rail. For example, it may be the case that an elevator car is caused to travel not only into a different elevator shaft but at the same time also to a different storey.

The travel of the elevator car between two elevator shafts along the rotated segment will, in the description below, be referred to as "horizontal travel" of the elevator car. This should be understood not as meaning that the elevator car is necessarily caused to travel exactly in a horizontal direction, but rather as meaning that the movement of the elevator car has at least a component in a horizontal direction.

No additional elements are required for the transfer, according to the invention, of the elevator car between two elevator shafts. In particular, no additional mechanism is required for transporting the elevator car from one elevator shaft into another. All of the elements, or at least substantially all of the elements, which are used for causing the vertical travel of the elevator car in the elevator shafts during normal operation of the elevator system are also used for causing the horizontal travel of the elevator car.

The elevator car does not have to be separated from any elements before being transferred into another elevator shaft. Furthermore, the elevator car does not need to be connected to any elements after being transferred into the other elevator shaft. The transfer, according to the invention, of the elevator car can be carried out without great expenditure of time.

Furthermore, no additional brakes are required for the horizontal travel. Brakes for the vertical travel of the elevator car are subjected to higher loads and must withstand greater forces than brakes for horizontal travel of the elevator car. Thus, brakes that are used for the normal operation of the elevator car can also be used for the horizontal travel of the elevator car.

The transfer according to the invention can be performed during normal operation of the elevator system. It is not necessary for the elevator system to be put out of operation for the transfer process. The transfer according to the invention of the elevator car takes place in particular in an automatic or fully automatic manner. The transfer can be performed even when passengers are situated in the elevator car. In particular, the transfer of the elevator car can be performed while passengers are in the process of being transported.

In a preferred refinement of the invention, the elevator car is initially situated in a first elevator shaft with a first rail. During the normal operation of the elevator system, the elevator car can be caused to move vertically in said first elevator shaft along the first rail. According to the invention, the elevator car is transferred from the first elevator shaft into a second elevator shaft. The elevator car is initially caused to travel to a first rotatable segment of the first rail in the first elevator shaft. Said first segment of the first rail is rotated out of its original vertical orientation. Furthermore, a second segment of a second rail in the second elevator shaft is rotated out of its original vertical orientation. Said rotated first segment and the rotated second segment form the rail along which the elevator car is caused to travel horizontally. The elevator car is thus caused to travel from the first elevator shaft into the second elevator shaft along the first and second rotated segments. Subsequently, the first and second segments are rotated back into their original vertical orientation. The elevator car is now situated in the second elevator shaft and can subsequently, in the normal operation of the elevator system, be caused to travel vertically in the second elevator shaft along the second rail.

The first and second segments may in this case each be arranged in the same storey. Here, it is in particular the case that the first and second segments are each rotated through 90° and the elevator car is transferred between the first and second elevator shafts in the corresponding storey. A transfer of the elevator car between different storeys is however also conceivable. In this case, the first segment is arranged in a first storey and the second segment is arranged in a second storey. The segments are rotated by a particular angle, and the elevator car is transferred from the first storey to the second storey.

In an advantageous refinement of the invention, the elevator car can be caused to travel along the rails in the elevator shafts by means of a linear drive or by means of multiple linear drives. The elevator system is thus configured as an elevator system without a machine room. In this case, the elevator car is caused to travel in particular without cables, in particular without supporting cables. Thus, in the elevator shafts, there are no supporting cables that would impede a transfer of the elevator car between the elevator shafts. Through the use of a linear drive, it is possible in particular for the elevator car to be caused to travel without a counterweight.

The cable-free travel of the elevator car can give rise to a further advantage. Elevator cars that are caused to travel by way of supporting cables, or which are suspended on supporting cables, reach design limits in the case of supporting cable lengths of approximately 500 m: at such lengths, supporting cables can be set in oscillation or motion whereby they strike the elevator shaft or the building, which can lead to problems with regard to the statics of the building. These disadvantages can be overcome through the use of a linear drive. The elevator car can thus also be caused to travel over building heights of greater than 500 m without problems.

It is preferably the case that a first element of the linear drive is formed by the rails of the elevator shafts. A second element of the linear drive is arranged on the elevator car. Said first and second elements of the linear drive interact with one another, whereby the elevator car can be caused to travel. The linear drive is in particular in the form of a long-stator linear motor. In this case, the first element is in the form of a stator or primary part. It is the case here in particular that coils through which electrical current is passed are arranged, as a stator, on the rail. The second element, which is arranged on the elevator car, is in this case in the form of a reaction part or secondary part. It is the case here in particular that at least one permanent magnet and/or at least one electromagnet is arranged, as reaction part, on the elevator car. The linear drive may on the other hand also be in the form of a short-stator linear motor. In this case, the second element, which is arranged on the elevator car, is in the form of a stator, and the first element is in the form of a reaction part. Furthermore, a configuration of the linear drive as an asynchronous linear drive is also conceivable. An asynchronous linear drive is in this case formed without permanent magnets or electromagnets.

It is furthermore preferably the case that the second element of the linear drive is mounted rotatably on the elevator car. In particular, the second element can be rotated with the segments of the rails. The second element of the linear drive can thus be rotated analogously to the first element of the linear drive and utilized for causing the horizontal travel of the elevator car. Thus, the first and second elements of the linear drive that are used for causing the vertical travel of the elevator car during the normal operation of the elevator system are also used for the transfer of the elevator car between two elevator shafts. Thus, no additional drive is required for the transfer of the elevator car.

The elevator car preferably also comprises a cabin and a chassis unit. The second element of the linear drive is arranged on said chassis unit of the elevator car. The chassis unit is mounted rotatably on the cabin of the elevator car. In particular, the chassis unit is connected to the cabin by way of a suspension axle and is mounted rotatably on said suspension axle. In this case, the chassis unit functions in particular as an elevator car suspension of the elevator car. The elevator car is in particular manufactured so as to be of lightweight construction. Thus, the loads that act on the elevator car suspension of the elevator car can be kept as low as possible.

Furthermore, the chassis unit functions in particular as a bracket for the drive or as a bracket for the second element of the linear drive. Furthermore, in particular, a safety apparatus or catch mechanism for preventing the elevator car from falling is arranged on the chassis unit. Said safety apparatus is triggered for example by a speed limiter if a speed of the elevator car exceeds a threshold value. A speed limiter of said type is in this case formed in particular as an electronic system. Here, in particular, the speed limiter evaluates sensor data in order to determine the speed of the elevator car. If the speed of the elevator car exceeds the threshold value, the speed limiter activates actuators in order to trigger the safety apparatus or the catch mechanism.

The elevator car suspension of the elevator car is preferably in the form of a rucksack-type suspension. The elevator car suspension is thus arranged on only one side of the elevator car. In particular, the chassis unit is in this case arranged on the same side of the elevator car. Thus, all of the elements for causing the travel of the elevator car are arranged on one side of the elevator car.

The rails are advantageously in the form of guide rails. In particular, corresponding guide rollers are arranged on the elevator car. In particular, said guide rollers are arranged on the chassis unit. The rails thus function both as a drive and as a guide for the elevator car. Said guide of the elevator car is thus also rotated together with the segments of the rails. No additional guides or no additional guide elements are required for the transfer of the elevator car.

In a preferred refinement of the invention, the elevator car comprises an arresting apparatus which is designed to arrest the cabin of the elevator car relative to the elevator shaft or on the chassis unit. When the cabin is arrested relative to the elevator shaft, the cabin is in particular decoupled from the chassis unit. In this case, the chassis unit can be rotated independently of the cabin or relative to the cabin. In particular, in this case, the cabin is decoupled from the chassis unit only in a direction of rotation along which the cabin is rotated. When the cabin is arrested on the chassis unit, a rotation of the chassis unit relative to the cabin is not possible.

It is preferably the case here that the cabin is arrested relative to the first elevator shaft while the segments or the first segment is or are being rotated. It is thus ensured that the cabin remains oriented in a vertical direction while the segments or the first segment, and thus the chassis unit, are or is being rotated. The cabin thus does not rotate together with the chassis unit. This is of importance in particular when passengers are situated within the cabin during the transfer process.

It is furthermore preferably the case that the cabin of the elevator car is arrested on the chassis unit after the segments have been rotated and are situated, for example, in their horizontal orientation. Here, the cabin of the elevator car is in particular arrested relative to the rotated segments or relative to the rotated first segment. In particular, the cabin is in this case arrested on the chassis unit. It is thus ensured that the cabin remains in a constant orientation during the course of the horizontal travelling process, and is not set in rotation, for example owing to inertial forces.

The cabin is in particular likewise arrested on the chassis unit during the normal operation of the elevator system, that is to say when the elevator car is caused to travel vertically along the rails.

It is preferably the case that the cabin of the elevator car is pivoted or rotated slightly relative to the elevator shafts about a horizontal axis while the elevator car is being caused to travel between the two elevator shafts along the rotated segments of the two rails. In this case, pivot angles of for example 1, 2, 3, 4, 5 or 6° are conceivable. Corresponding pivoting may also in the case of an arbitrary Acceleration of the elevator car during the course of the horizontal travel of the elevator car causes a corresponding acceleration force to be exerted on the cabin, this hereinafter being referred to as horizontal acceleration force. Owing to said horizontal acceleration force, there is the risk that passengers in the cabin may lose their balance and lose their footing. The pivot angle is set such that the resultant force arising from gravitational force and horizontal acceleration force is perpendicular to the floor of the elevator car. Pivot angles of up to 6° may be considered for typical levels of horizontal acceleration.

The pivot angle need not imperatively be constant, but may also be configured so as to vary over time in accordance with the horizontal acceleration process.

The described pivoting process may be implemented not only along the rotated segments but also along fixed horizontal segments.

Owing to the rotational movement of the cabin relative to the elevator shafts or relative to the rails or relative to the chassis unit, the floor of the elevator car is inclined relative to the horizontal, such that the resultant force arising from the gravitational force on the passengers and the horizontal acceleration force is perpendicular to the floor of the elevator car. For the passengers in the elevator car, therefore, the impression that the total force acts downward is maintained. For the passengers, "downward" refers to the direction toward the floor of the elevator car.

As mentioned, the cabin is rotated only by a relatively small angle. During the course of said rotation of the cabin, the cabin is arrested neither relative to the elevator shaft nor on the chassis unit. In particular, the arresting apparatus is in this case deactivated.

It is advantageously the case that a compensation rail element is arranged between rotated segments of two rails of two elevator shafts. A compensation rail element of said type bridges a free space between rotated segments. It is thus possible for component tolerances of the elevator shafts to be compensated for. The compensation rail element is of analogous design to the rails, and in particular forms the first part of the linear drive and guide rails for the elevator car. The rotated segments and the compensation rail element form a (substantially) closed rail (substantially) without gaps, along which the elevator car is caused to travel horizontally.

The invention also relates to a method for operating an elevator system. Refinements of this method according to the invention emerge analogously from the above description of the elevator system according to the invention. An expedient processing unit, in particular a control unit of an elevator system, is set up, in particular in terms of programming technology, to carry out a method according to the invention.

With reference now to the figures, it should be understood that further advantages and refinements of the present disclosure will emerge from the description and from the appended drawings.

Likewise, those having ordinary skill in the art will appreciate that the features mentioned above and the features yet to be discussed below can be used not only in the respectively specified combinations but also in other combinations or individually without departing from the scope of the present disclosure.

A preferred refinement of an elevator system according to the invention is illustrated schematically and denoted by 100 in FIGS. 1 to 4.

The elevator system 100 comprises two elevator shafts 101*a* and 101*b*. A physical barrier 102, for example a partition or a wall, may be formed between the elevator shafts 101*a* and 101*b* at least in parts. It is however also possible for a physical barrier 102 between the elevator shafts 101*a* and 101*b* to be omitted.

A first rail 110*a* is arranged in a first elevator shaft 101*a*, and a second rail 110*b* is arranged in a second elevator shaft 101*b*. An elevator car 200 can be caused to travel along said rails 110*a* and 110*b*, said elevator car being situated in the elevator shaft 101*a* or 101*b* respectively.

The elevator car 200 comprises a cabin 210 and a frame or chassis unit 220. The chassis unit 220 functions as a suspension for the cabin 210. The chassis unit 220 is connected to the cabin 210 by way of a suspension axle 221. The chassis unit 220 is in this case mounted so as to be rotatable about said suspension axle 221. By means of an arresting apparatus 230, the cabin 210 can be arrested on the chassis unit 220, wherein, in said arrested state, it is not possible for the chassis unit 220 to rotate about the suspension axle 221.

The elevator car 200 can be caused to travel along the rails 110*a* and 110*b* by means of a linear drive 300. In this case, the rails 110*a* and 110*b* form a first element 310 of said linear drive 300. In this case, said first element 310 is in particular in the form of a primary part or a stator 310 of the linear drive 300, more particularly a long stator.

A second element 320 of the linear drive 300 is arranged on the chassis unit 220 of the elevator car 200. Said second element 320 is in particular in the form of a secondary part or reaction part 310 of the linear drive 300. The second element 320 is for example in the form of a permanent magnet.

The rails 110*a* and 110*b* are formed not only as first element 310 of the linear drive 300 but simultaneously also as guide rails for the elevator car 200. For this purpose, the rails 110*a* and 110*b* have, in particular, a suitable guide element 410. Said guide element 410 is engaged on by guide rollers 420 which are formed on the chassis unit 220 of the elevator car 200.

The elevator car 200 has a rucksack-type suspension. In particular, the chassis unit 220 and rails 110*a* and 110*b* are arranged at a rear side of the elevator car 200. In this case, the rear side is situated opposite an entrance side of the elevator car 200. The entrance side of the elevator car 200 has a door 211. As the rails 110*a* and 110*b* function both as guide rails and as part of the linear drive 300, substantially no additional elements are required in the elevator shafts 110*a* or 110*b* for causing the travelling movement of the elevator car 200.

According to the invention, the elevator car 200 is not restricted to being caused to travel only within one of the elevator shafts 110*a* or 110*b*, but can be caused to travel between the two elevator shafts 110*a* and 110*b*.

A control unit 600, which is illustrated purely schematically in the figures, is set up, in particular in terms of programming technology, to carry out a preferred embodiment of a method according to the invention for operating the elevator system 100. It is the case here in particular that the control unit 600 actuates the linear drive 300 and causes the travel of the elevator car 200.

Furthermore, the control unit 600 controls a changeover or travel of the elevator car 200 between the elevator shafts 110*a* and 110*b*.

Below, on the basis of FIGS. 1 to 4, a description will be given, by way of example, of a situation in which the elevator car 200 is initially caused to travel in the first elevator shaft 101*a* and is then transferred from the first elevator shaft 101*a* into the second elevator shaft 101*b*.

Here, a changeover between the elevator shafts 101*a* and 101*b* takes place in particular in a transfer plane 500. In the region of this transfer plane 500, the barrier 102 has an opening 103. The elevator car 200 can be caused to travel between the elevator shafts 101*a* and 101*b* through said opening 103.

In the region of said transfer plane 500, the first rail 110*a* has a first rotatable segment 120*a*, and the second rail 110*b* has a second rotatable segment 120*b*. The first segment 120*a* and the second segment 120*b* are mounted so as to be rotatable about a first rotary axle 121*a* and about a second rotary axle 121*b* respectively. In FIG. 1, the first rotary axle 121*a* is illustrated, merely by way of example, as being coincident with the suspension axle 221, though need not imperatively be coincident with the suspension axle 221. The rotatable segments 120*a* and 120*b* are likewise actuated by the control unit 600.

In the figures, the rotatable segments 120*a* and 120*b* are illustrated, merely by way of example, as being of rectangular form. The segments 120*a* and 120*b* may also have a circular arc-shaped curvature at their ends at which they adjoin the other parts of rails 110*a* and 110*b*. Correspondingly, the rails 110*a* and 110*b* may likewise have an equal and inverse circular arc-shaped curvature at the locations at which they adjoin the segments 120*a* and 120*b*. It is thus ensured that the segments 120*a* and 120*b* do not abut or become jammed against the other parts of the rails 110*a* and 110*b* during the course of the rotation.

Figure 2:
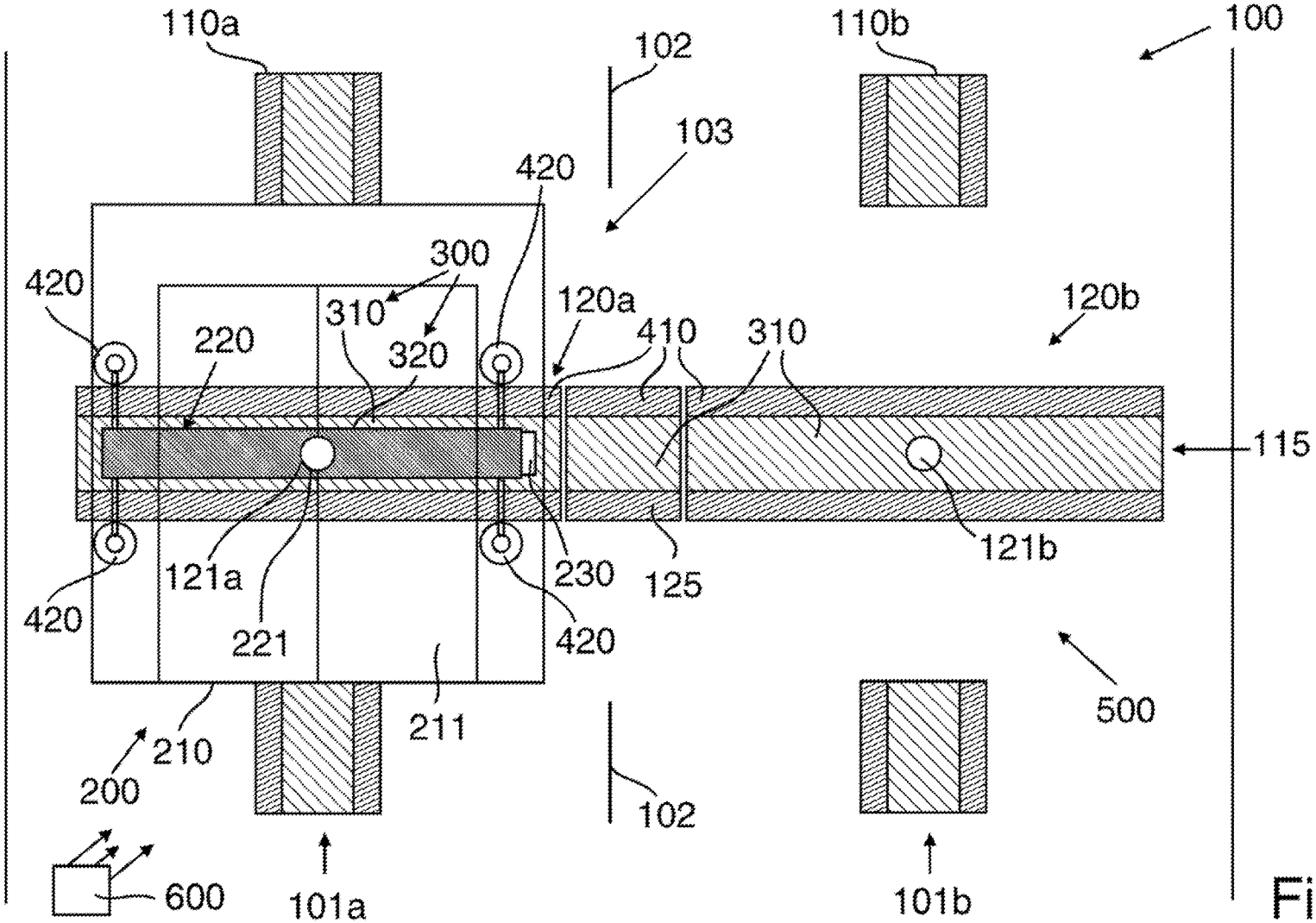
FIG. 2 is a schematic view of an example elevator system similar to that shown in FIG. 1, except wherein example first and second segments have been rotated 90 degrees into a horizontal orientation.

For the transfer of the elevator car 200 from the first elevator shaft 101*a* into the second elevator shaft 101*b*, the segments 120*a* and 120*b* are rotated from a vertical orientation, as shown in FIG. 1, into a horizontal orientation, as shown in FIG. 2 and explained in detail further below.

Furthermore, in the region of the transfer plane 500, a compensation rail element 125 is arranged between the rails 110*a* and 110*b*. Said compensation rail element 125 serves for bridging a free space or gap between the segments 120*a* and 120*b* that have been rotated into the horizontal orientation. The compensation rail element 125 functions, analogously to the rails 110*a* and 110*b*, as first element 310 of the linear drive 300, and has guide elements 410 in order to simultaneously serve as a horizontal guide rail for the elevator car 200.

Analogously to the rails 110*a* and 110*b*, the compensation rail element 125 may also have a circular arc-shaped curvature at its ends, in particular with an equal and inverse curvature in relation to the corresponding ends of the segments 120*a* and 120*b*.

The elevator car 200 is initially caused to travel along the first rail 110*a* into the transfer plane 500. FIG. 1 illustrates the situation in which the elevator car 200 is already situated in said transfer plane 500.

The cabin 210 of the elevator car 200 is now arrested relative to the first elevator shaft 101*a* by means of the arresting apparatus 230. In this case, the cabin 210 may for example be fastened to a suitable shaft element of the elevator shaft 101*a*. At the same time, the chassis unit 220 is arrested on the first segment 120*a*, and the cabin 210 is decoupled from the chassis unit 220. The chassis unit 220 can now be rotated without the cabin 210 likewise rotating.

The first segment 120*a* of the first rail 110*a* is rotated through 90° about the first rotary axle 121*a*. Furthermore, the second segment 120*b* of the second rail 110*b* is rotated through 90° about the second rotary axle 121*b*. With the rotation of the first segment 120*a*, the chassis unit 220 of the elevator car 220 is also rotated through 90° about the suspension axle 221. Since the cabin 221 is arrested relative to the first elevator shaft 101*a*, the cabin in this case remains in its orientation relative to the elevator shaft 101*a*.

FIG. 2 is a schematic illustration of the elevator system 100 analogous to FIG. 1, wherein the first segment 120*a* and the second segment 120*b* have each been rotated through 90° into the horizontal orientation.

As can be seen in FIG. 2, the first segment 120*a* that has been rotated into the horizontal orientation, the second segment 120*b* that has been rotated into the horizontal orientation and the compensation rail element 125 now form a horizontal rail 115. The horizontal rail 115 is a (substantially) closed rail and is formed (substantially) without gaps.

Subsequently, the cabin 210 of the elevator car 200 is released from the arresting or fastening action relative to the elevator shaft, and is arrested on the chassis unit 220 again by means of the arresting apparatus 230.

The elevator car 200 is then caused to travel along the horizontal rail 115. In this case, the second element 320 of the linear drive 300 on the elevator car 200 interacts with the first element 310 of the linear drive, that is to say in this case with the horizontal rail 115.

The elevator car 200 is thus caused to travel from the first elevator shaft 101*a* into the second elevator shaft 101*b*, and is thus changed over between the elevator shafts 101*a* and 101*b*.

Figure 3:
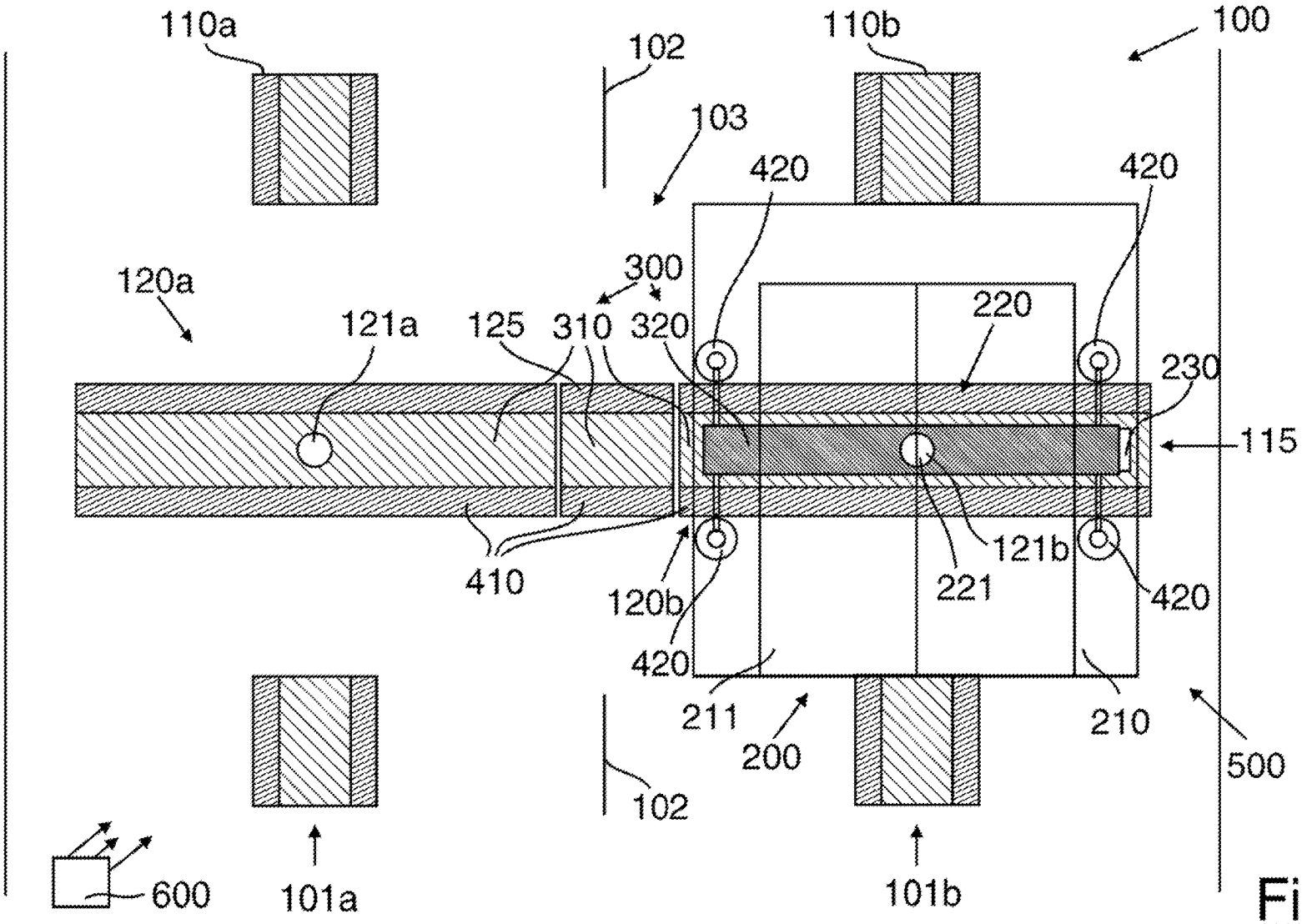
FIG. 3 is a schematic view of an example elevator system similar to that shown in FIG. 2, except wherein an example elevator car has traveled to a rotated second segment of an example second rail of a second elevator shaft.

FIG. 3 is a schematic illustration of the elevator system 100 analogous to FIG. 2, wherein the elevator car 200 has been caused to travel to the rotated second segment 120*b* of the second rail 110*b* of the second elevator shaft 101*b*.

The cabin 210 of the elevator car 200 is now arrested by means of the arresting apparatus 230 relative to the second elevator shaft 101*b*, for example on a corresponding shaft element of the elevator shaft 101*b*. At the same time, the chassis unit 220 is decoupled from the cabin 210 and arrested on the rotated second segment 120*b*.

Subsequently, the rotated first and second segments 120*a* and 120*b* are rotated through 90° about their respective rotary axle 121*a* and 121*b* into the vertical orientation. With the rotation of the second segment 120*b*, the chassis unit 220 is also rotated through 90° about the suspension axle 221. In FIG. 3, the second rotary axle 121*b* is, merely by way of example, illustrated as being coincident with the suspension axle 221. Since the cabin 210 is arrested relative to the second elevator shaft 101*b*, the cabin 210 in this case remains in its orientation relative to the elevator shaft 101*b*.

Figure 4:
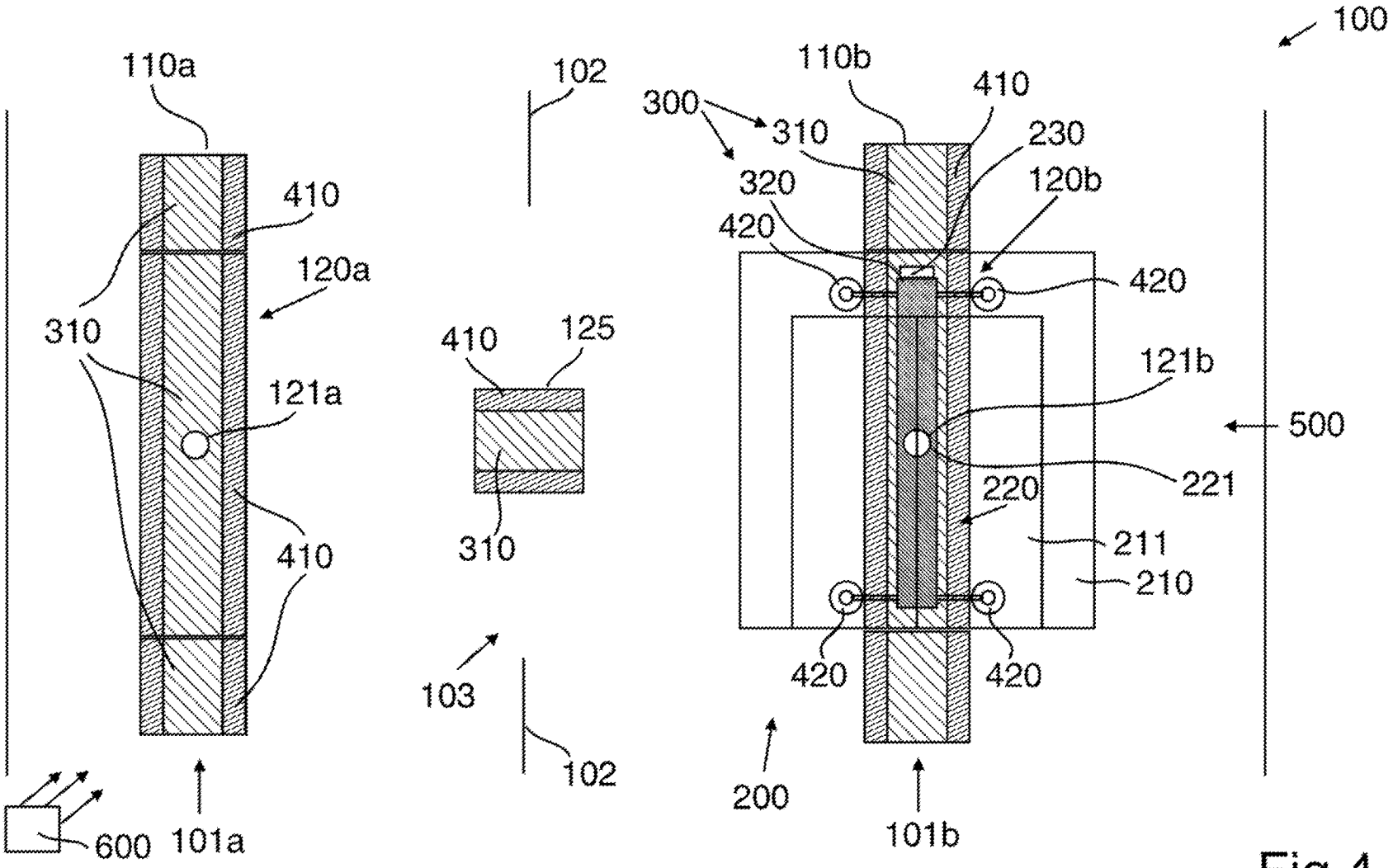
FIG. 4 is a schematic view of an example elevator system similar to that shown in FIG. 1, except wherein an example elevator car is positioned in an example transfer plane in a second elevator shaft.

FIG. 4 is a schematic illustration of the elevator system 100 analogous to FIG. 1, wherein the first segment 120*a* and the second segment 120*b* are in the vertical orientation again.

The elevator car 200 is now arranged in the second elevator shaft 101*b* and can be caused to travel by means of the linear drive 300 along the second rail 110*b* in the second elevator shaft 101*b*. The second element 320 of the linear drive 300 on the elevator car 200 interacts in this case with the first element 310 of the second rail 110*b*.

What is claimed is:

1. An elevator system comprising:

an elevator car;

a first shaft;

a second shaft;

a vertically extending rail disposed within each of the first and second shafts along which the elevator car can travel, each vertically extending rail comprising a rotatable segment, wherein the rotatable segments are configured to be rotated into alignment with each other such that the elevator car can travel along the rotatable segments between the vertically extending rails disposed in each of the first and second elevator shafts;

a linear drive configured to move the elevator car along each of the vertically extending rails, the linear drive comprising:

in each of said first and said second shafts, a first element that is a stationary part disposed at a fixed position relative to said respective vertically extending rail, and a second element disposed on the elevator car, wherein the second element is either mounted rotatably on the elevator car or disposed on a chassis unit that is mounted rotatably on a cabin of the elevator car, said second element configured to be in operative communication with and driven by said first element, wherein one of said first element or said second element is a stator, and the other of said first element or said second element is a reaction part; and an arresting apparatus configured to arrest the elevator car relative to the elevator shafts and thereby maintain the elevator car locked in a constant vertical orientation during rotation of the rotatable segment.

2. The elevator system of claim 1 wherein the chassis unit is disposed on a rear side of the elevator car.

3. The elevator system of claim 1 wherein the vertically extending rails are guide rails.

4. The elevator system of claim 1 wherein the apparatus is configured to arrest the cabin of the elevator car on the chassis unit.

5. The elevator system of claim 1 further comprising a compensation rail element disposed between the rotatable segments of the vertically extending rails.

6. An elevator system comprising:

an elevator car;

a first vertically extending rail along which said elevator car is configured to travel, said first vertically extending rail having a first rotatable rail segment;

a second vertically extending rail along which said elevator car is configured to travel, said second vertically extending rail having a second rotatable rail segment, said first and second vertically extending rails being disposed laterally relative to each other, wherein said first and second rotatable rail segments are configured to be rotated into alignment with each other such that said elevator car can travel along said first and second rotatable rail segments between said first and second vertically extending rails; and a linear drive configured to move said elevator car along each of said first and second vertically extending rails, said linear drive comprising:

a stator, and a reaction part in operative communication with said stator, wherein, for each of said first and second vertically extending rails, one of said stator or said reaction part is a stationary part that is disposed at a fixed position relative to said respective first or second vertically extending rails, and wherein the other of said stator or said reaction part is either rotatably mounted on the elevator car or disposed on a chassis unit that is rotatably mounted on a cabin of the elevator car, and is configured to be driven with respect to said one of said stator or reaction part; and an arresting apparatus configured to arrest the elevator car relative to the elevator shafts and thereby maintain the elevator car locked in a constant vertical orientation during rotation of the rotatable segment.

7. The elevator system of claim 6, wherein said chassis unit is disposed on a rear side of the elevator car.

8. The elevator system of claim 6, wherein each of said first and second vertically extending rails are guide rails.

9. The elevator system of claim 6, wherein said arresting apparatus is configured to arrest the cabin of said elevator car relative to said respective first and second vertically extending guide rails.

10. The elevator system of claim 6, further comprising a compensation rail element disposed between said first rotatable rail segment and said second rotatable rail segment.

11. The elevator system of claim 6, wherein the arresting apparatus is configured to decouple the cabin from the chassis unit to permit the chassis unit to rotate with the rotatable segment.

12. An elevator system comprising:

an elevator car;

a first shaft;

a second shaft;

a vertically extending rail disposed within each of the first and second shafts along which the elevator car can travel, each vertically extending rail comprising a rotatable segment, wherein the rotatable segments are configured to be rotated into alignment with each other such that the elevator car can travel along the rotatable segments between the vertically extending rails disposed in each of the first and second elevator shafts;

a linear drive configured to move the elevator car along each of the vertically extending rails, the linear drive comprising:

in each of said first and said second shafts, a first element that is a stationary part disposed at a fixed position relative to said respective vertically extending rail, and a second element disposed on the elevator car, wherein the second element is either mounted rotatably on the elevator car or disposed on a chassis unit that is mounted rotatably on a cabin of the elevator car, said second element configured to be in operative communication with and driven by said first element, wherein one of said first element or said second element is a stator, and the other of said first element or said second element is a reaction part; and an arresting apparatus configured to arrest the cabin on the chassis unit and thereby maintain the elevator car locked in a constant vertical orientation during vertical travel along the rails.

13. An elevator system comprising:

an elevator car;

a first shaft;

a second shaft;

a vertically extending rail disposed within each of the first and second shafts along which the elevator car can travel, each vertically extending rail comprising a rotatable segment, wherein the rotatable segments are configured to be rotated into alignment with each other such that the elevator car can travel along the rotatable segments between the vertically extending rails disposed in each of the first and second elevator shafts;

a linear drive configured to move the elevator car along each of the vertically extending rails, the linear drive comprising:

in each of said first and said second shafts, a first element that is a stationary part disposed at a fixed position relative to said respective vertically extending rail, and a second element disposed on the elevator car, wherein the second element is either mounted rotatably on the elevator car or disposed on a chassis unit that is mounted rotatably on a cabin of the elevator car, said second element configured to be in operative communication with and driven by said first element, wherein one of said first element or said second element is a stator, and the other of said first element or said second element is a reaction part; and an arresting apparatus configured to arrest the cabin to the elevator shaft and thereby maintain the elevator car locked in a constant vertical orientation during rotation of the rotatable segment.

* * * * *